US005941114A

United States Patent [19]

Kusaba

[11] Patent Number: 5,941,114

[45] **Date of Patent: *Aug. 24, 1999**

[54] ROLLING APPARATUS FOR PRODUCING ANGLE FROM STEEL STRIP AND METHOD OF ROLLING THE ANGLE USING THE SAME

[75] Inventor: Yoshiaki Kusaba, Osaka, Japan

[73] Assignee: Sumitomo Metal Industries, Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,406

[22] PCT Filed: Jul. 13, 1995

[86] PCT No.: PCT/JP95/01402

§ 371 Date: Jan. 8, 1997

§ 102(e) Date: Jan. 8, 1997

[87] PCT Pub. No.: WO96/02333

PCT Pub. Date: Feb. 1, 1996

[30] Foreign Application Priority Data

Jul. 19, 1994 [JP] Japan ..... 6-166614

[51] Int. Cl.[6] ..... B21B 15/00

[52] U.S. Cl. ..... 72/177; 72/178; 72/200; 72/342.96; 72/377

[58] Field of Search ..... 72/177, 178, 200, 72/202, 377, 342.96, 342.94

[56] References Cited

U.S. PATENT DOCUMENTS

| | | | |
|---|---|---|---|
| 1,347,917 | 7/1920 | Sheperdson . | |
| 1,978,220 | 10/1934 | Otte | 72/342.96 |
| 2,184,150 | 12/1939 | Parker | 72/202 |
| 4,433,565 | 2/1984 | Preller | 72/177 |

FOREIGN PATENT DOCUMENTS

| | | | |
|---|---|---|---|
| 102204 | 6/1985 | Japan | 72/177 |
| 32401 | 2/1991 | Japan | 72/177 |
| 3-060802 | 3/1991 | Japan . | |
| 4-356314 | 12/1992 | Japan . | |
| 5-154503 | 6/1993 | Japan . | |
| 5-154596 | 6/1993 | Japan . | |
| 5-237503 | 9/1993 | Japan . | |
| 6-015301 | 1/1994 | Japan . | |
| 6-047405 | 2/1994 | Japan . | |
| 6-154803 | 3/1994 | Japan . | |
| 448042 | 10/1974 | U.S.S.R. | 72/200 |

*Primary Examiner*—Daniel C. Crane
*Attorney, Agent, or Firm*—Burns, Doane, Swecker & Mathis, LLP

[57] ABSTRACT

A rolling system for producing an angle and a rolling method using such rolling system. The rolling system includes a heating apparatus for heating a steel strip while it is running, a universal mill composed of a pair of vertical rolls each having a groove in the peripheral surface thereof, and a pair of horizontal rolls. One of the pairs of the horizontal rolls have a groove at a longitudinal central portion thereof. Also provided is a group of two-high mills with grooved rolls that are closely disposed one behind the other. The heating apparatus may include a direct current-applying heating apparatus. Since the steel strip that is rolled on the universal mill increases the thickness of a central portion thereof, it is possible to roll an angle from a steel strip whose thickness is the same as the thickness of the flanges of the produced angle.

3 Claims, 10 Drawing Sheets

ROLLING APPARATUS FOR PRODUCING ANGLE FROM STEEL STRIP AND METHOD OF ROLLING THE ANGLE USING THE SAME

This application is a 371 of PCT/JP95/01402, filed Jul. 13, 1995.

TECHNICAL FIELD

The present invention relates to a hot-rolling apparatus or system for producing from a steel strip an angle of stainless steel with a cross-sectional shape having a small outside radius at a corner portion thereof, and a rolling method using such hot-rolling system.

BACKGROUND ART

Angle steels or angles have been frequently used as a member of the structure for many years.

FIG. 1 is a view showing one example of the cross section of an angle produced by hot-rolling, in which reference character A represents the length of one side of a flange (A being hereinafter referred to as "flange"), t the thickness of the flange, $r_1$ the inside radius of an angled corner portion, and $r_2$ the outside radius of the corner portion. In general, these dimensions are stipulated by JIS (Japanese Industrial Standards) except for the outside radius of the corner portion. Those angles which are made of stainless steel for use in kitchens or chemical plants require an angled corner portion having an outside radius $r_2$ not exceeding 1 mm (hereinafter simply referred to as "sharp edge") to secure the aesthetical appearance of a structure which is built up with the angles.

The method of producing angles is generally divided into two types; the first method is a hot-rolling method using a mill having grooved rolls between which a continuous cast bloom is passed, the other is a method of producing a light angle from a steel strip by means of a roll forming (bending) machine while the steel strip is still in hot or cold state.

The term "steel strip" is used herein to refer to a narrow band-like sheet material produced by slitting a wide steel sheet in the longitudinal direction.

FIG. 2 is a view showing a succession of passes (pass schedule) defined between two rolls for producing an angle by the hot-rolling method. In the production of the angle, a continuous cast bloom (billet) used as a blank is hot-rolled into the angled shape shown in FIG. 1 by making seven, eight or more passes between seven or eight pairs of grooved rolls.

In such rolling, when a material M' to be rolled passes between the grooved rolls, friction is generated due to a difference in peripheral speed between the grooved rolls at respective portions corresponding to flanges of an angle. However, the friction thus generated deteriorates surface qualities of the angle. To deal with this problem, an improved method of producing a stainless steel angle of excellent surface qualities has been proposed as disclosed in Japanese Patent Laid-open Publication No. 5-237503, which includes forming rolls disposed in front of the grooved rolls to bend a corner portion of the material.

FIG. 3 is a view showing a method of producing an angle from a steel strip via a cold-forming process. In this method, a blank sheet S is worked or processed by bending, and hence is not subjected to a reduction in thickness. Accordingly, the outside radius $r_2$ of an angled corner portion is about twice the thickness of the blank sheet. For example, a stainless steel strip of 3 mm in thickness is formed into an angle having a flange thickness of 3 mm, a corner portion of the angle has an outside radius $r_2$ of about 6 mm. The angle thus produced is not suitable for use in the kitchen.

When a blank sheet composed of a steel strip is to be shaped by hot rolling into an angle, the thickness B of a corner portion of the angle shown in FIG. 1 requires to be about 1.5 times the flange thickness t. This means that the use of a steel strip having the same thickness as the flanges of a rolled product is unable to realize rolling of an angle having a desired sharp edge. To realize the desired rolling, a steel strip having a thickness greater than the thickness of the corner portion should be used.

FIG. 4 is a view illustrative of the manner in which a rough-rolled material for an angle is produced from a steel strip having a thickness greater than the thickness of a corner portion of the angle, in which FIG. 4(*a*) is a view showing the cross section of the rough-rolled material, and FIG. 4(*b*) is a view showing edge waves appearing on the rough-rolled material. As shown in FIG. 4(*a*), by using a two high mill, the steel strip S (indicated by the broken line) of a thickness T greater than the thickness B of a corner portion of the angle as in FIG. 1 is shaped into the rough rolled material M" by reducing the thickness of the steel strip S at portions C corresponding to flanges of an angle.

However, since the thickness of the steel strip is much smaller than the width, when opposite sides of the steel strip being rolled undergo a great reduction in thickness except a portion (a central portion, for example), wave-like wrinkles, called "edge waves", such as shown in FIG. 4(*b*) are generated due to variations in widthwise elongation or spread of the steel strip. The edge waves may still present as wave-like deformations on the flanges of a finished angle even when finish rolling is completed. As a result, the angle is evaluated as a defective product.

The rolling method of shaping an angle by hot rolling with the use of a rolling apparatus or system having grooved rolls defining multiple passes as shown in FIG. 2 is not suitable for the production small-sized angles made of stainless steel. For instance, when an angle having flanges of 30 mm in length and 3 mm in thickness (the size of such angle being hereinafter referred to as 30×30×3) is to be produced from a continuous cast billet having a 120 mm square cross section, the billet requires to be passed through the passes more than 15 times (15 passes). During that time, the roll-finishing temperature drops below 800° C. at which the material has an insufficient degree of workability, resulting in a product having deteriorated surface qualities. To deal with this problem, reheating must be incorporated during the rolling, which will, however, incur a reduction of the rolling efficiency.

According to the method in which a hot or a cold blank sheet consisting of a steel strip is bent, production of an angle having a sharp edge is not possible, as discussed above. Further, the method of reducing a steel strip only at a portion corresponding to the flanges of an angle to be produced encounters a problem that edge waves are generated when a severe reduction is employed. To deal with this problem, a small reduction must be employed, however, this will result in an increased number of rolling passes required and an increased equipment cost. Yet, the method including the use of forming rolls disposed in front of the grooved rolls creates a problem that due to a reduction in thickness of the angled corner portion, a sharp edge is difficult to obtain. Another problem is that this rolling system is complicated as a whole.

As discussed above, an angle having a sharp edge can be produced from a cast billet by the use of a rolling system having grooved rolls.

However, so far as a small-sized angle is concerned, such rolling system requires an increased number of rolling passes and tends to deteriorate the surface qualities of the angle.

DISCLOSURE OF THE INVENTION

It is an object of the present invention to provide a rolling apparatus or system for producing an angle having a good surface condition and a sharp edge via hot rolling from a steel strip having the same thickness as flanges of the produced angle, and an inexpensive rolling method using the rolling system.

The present inventor completed the present invention based on a fact confirmed that when opposite sides of a steel strip are reduced in the widthwise direction using a universal mill composed of a pair of vertical rolls each having a groove in its peripheral surface, and a pair of horizontal rolls one of which has a groove at a longitudinal central portion thereof, the thickness of a widthwise central portion of the steel strip can be increased without generation of edge waves.

The gist of the present invention resides in rolling apparatuses or systems shown in FIGS. 5 to 8 and methods using them for rolling an angle from a steel strip.

More particularly, the present invention seeks to provide:

[1] A rolling system which comprises, as shown in FIG. 5, a heating apparatus (H) for heating a steel strip (S) while it is running, a universal mill (U), and a group of two high mills (R) with grooved rolls that are disposed closely one behind another, wherein said universal mill (Ul) is composed of a pair of vertical rolls (3, 3) each having a groove (13) in its peripheral surface, and a pair of horizontal rolls (1, 2), one horizontal roll (1) having a groove (12) formed in a peripheral surface at a central portion thereof.

The other horizontal roll (i.e., a lower horizontal roll 2' described later with reference to FIG. 6(*b*)) preferably has, on its peripheral surface, a projection (14) at a longitudinal central portion thereof.

[2] A rolling system as recited in the preceding paragraph [1] wherein the heating furnace comprises an apparatus (H2) for heating the steel strip by directly applying an electric current to the steel strip (see FIGS. 7 and 8).

[3] A rolling system as recited in the preceding paragraph [1] wherein the heating apparatus comprises at least one pair of current supply rolls (7, 8), an insulated universal mill (U) and a grounded two high mill (R) with grooved rolls (see FIG. 8).

[4] A rolling system as recited in the preceding paragraph [3] wherein the current-applying heating apparatus is composed of two pairs of current supply rolls (7, 8), one current supply roll pair (7) being equipped with a device for moving the current supply rolls (7) in a direction parallel to the running direction of the steel strip, the other current supply roll pair (8) being equipped with a roll releasing device (see FIG. 8).

[5] A rolling method of the type wherein using a universal mill which is composed of a pair of vertical rolls (3, 3) each having a groove (13) in its peripheral surface, and a pair of horizontal rolls, one of said pair of horizontal rolls having a groove (12) at a central portion thereof, the steel strip is reduced in the widthwise direction and the widthwise direction for increasing the thickness of a widthwise central portion of the steel strip, and thereafter using a two high mill with grooved rolls, the steel strip is finished into an angle.

[6] A rolling method of the type wherein prior to the start of a rolling operation using a rolling system including a current-applying heating apparatus (H2) composed of two pairs of upper and lower current supply rollers (7, 8) disposed upstream of an universal mill, said two pairs of current supply rolls are disposed closely with each other in a running direction of the steel strip: then when the steel strip (S) while running is bit by a downstream one (8) of said two pair of current supply rolls, an electric current is applied to the steel strip while the upstream current supply roll pair is moved in a direction opposite to the running direction of the steel strip; and thereafter, when the steel strip is heated to a predetermined temperature, the steel strip is run at a rolling speed and, at the same time, the downstream current supply roll pair is released from rolling engagement with the steel strip to thereby ensure that while the steel strip is continuously heated by the current applied thereto between the upstream current supply roll pair (7) and the universal roll or between the upstream current supply roll pair (7) and a finishing mill, the steel strip is reduced in the widthwise direction and the thickness-wise direction to increase the thickness of its widthwise central portion by the use of the universal mill which is composed of a pair of vertical rolls each having a groove in its peripheral surface, and a pair of horizontal rolls one of which has a groove at a longitudinal central portion thereof, and thereafter the steel strip is finished into an angle using the two high finishing mill with grooved rolls.

BEST MODE FOR CARRYING OUT THE INVENTION

According to a rolling system of the present invention for producing an angle, a steel strip having the same thickness as the thickness of the flanges of a rolled or finished angle can be rolled into a desired product, i.e., the angle by making at least two rolling passes using rolls of a universal mill which are different in shape and configuration from those of the conventional universal mill.

A. Shape-rolling of a rough-rolled material by a universal mill:

An experimental study was made to attain the mode of deformation of a steel strip observed when the steel strip is reduced in the widthwise direction by left and right vertical rolls of a universal mill. Using left and right vertical rolls of 400 mm in diameter each having, in its peripheral surface, two grooves having the same bottom width of 5 mm, the same taper angle of 8° and different depths of 3 mm and 10 mm, strips of stainless steel (SUS 304) heated at 900° C. and having a thickness of 5 mm and a width of 100 mm were reduced by 30 mm at the maximum in the widthwise direction.

Figure 9:
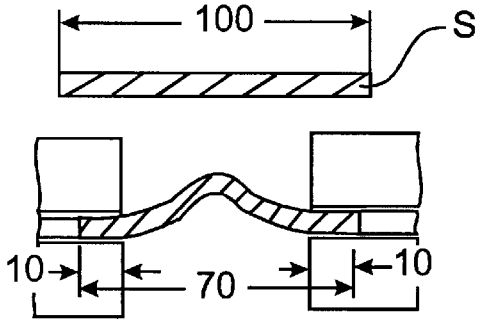
FIGS. 9 and 10 are views showing two different buckling modes observed when a steel strip is reduced in the widthwise direction while opposite sides of the steel strip are constrained over a predetermined distance, the distance being 10 mm in the case of FIG. 9, or alternatively 3 mm in the case of FIG. 10.

FIG. 9 is a view showing one mode of deformation observed when the steel strip was reduced in the widthwise direction by the grooved rolls, with its opposite sides constrained over 10 mm. When the steel strip S was reduced in the widthwise direction with its opposite sides constrained over 10 mm, buckling occurred in the U type buckling mode (illustrated buckling mode being of the inverted U type) in which a widthwise central portion of the steel strip was bent.

Figure 10:
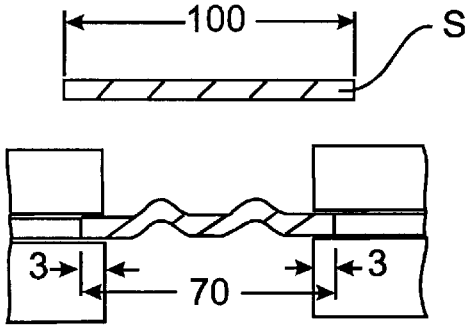

FIG. 10 is a view showing another mode of deformation observed when the steel strip was reduced in the widthwise direction by the grooved rolls, with its opposite sides constrained over 3 mm. With this 3-mm-constraint, the buckling mode which occurred was of the W type (illustrated buckling mode being of the inverted W type) in which the steel strip was bent at two portions which are offset laterally in opposite directions from the widthwise central portion of the steel strip.

Figure 11:
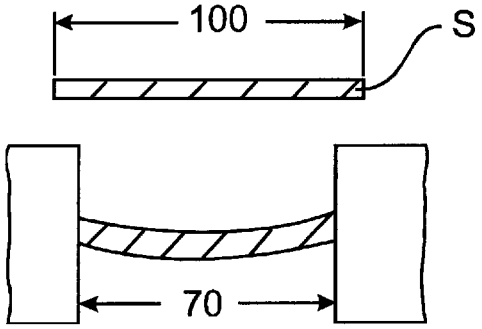
FIG. 11 is a view showing a buckling mode observed when a steel strip is reduced in the widthwise direction with its opposite sides kept free from constraint.

FIG. 11 is a view showing a buckling mode observed when a steel strip is reduced in the widthwise direction with its opposite sides kept free from constraint. In this case, since opposite sides of the steel strip S were not restrained, buckling occurred at the opposite side portions of the steel strip as shown in the same figure.

From the foregoing results, it will be understood that deformation generated at the central portion of the steel strip is substantially variable according to the degree of restraint effected at the opposite sides of the steel strip which is determined by the depth of the grooves in the vertical rolls.

When the steel strip, while being buckled in the mode shown in FIG. 9, is reduced thickness-wise or in the direction of thickness by horizontal rolls having a groove at their longitudinal central portion, a rough-rolled material having a thickened central portion can be obtained.

For purposes of confirmation, an experiment was conducted to study variations or changes in thickness observed when the steel strip is reduced in the widthwise direction using a model mill.

Figure 12:
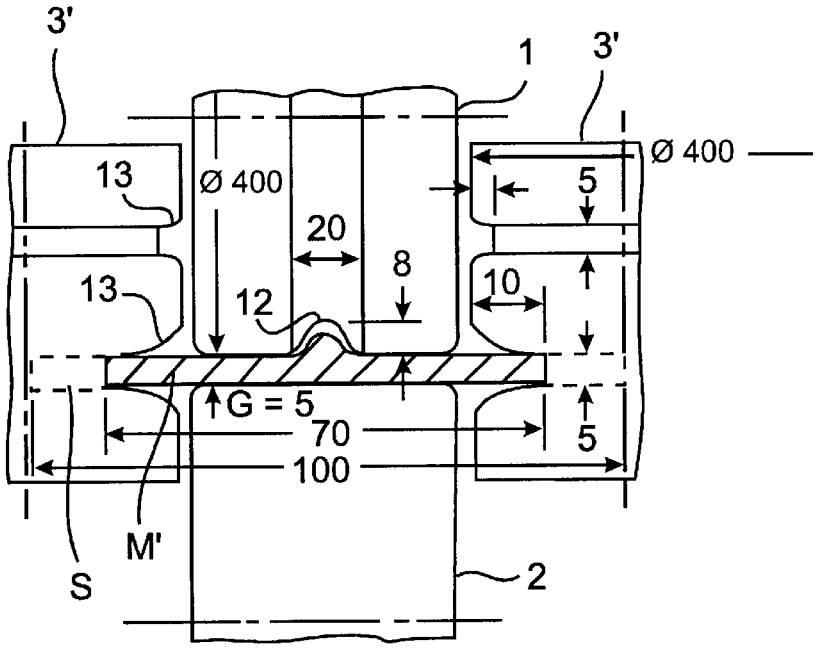
FIG. 12 is a view showing the cross section of a material being rolled and the arrangement of rolls of a universal mill used in a width reduction test.

FIG. 12 is a view showing the cross section of a material being rolled and the arrangement of rolls of a universal mill used in the experiment. Vertical rolls 3', 3' of 400 mm in diameter each had, in its peripheral surface, two grooves of the same bottom width of 5 mm and the same taper angle of 8° and having different depths of 3 mm and 10 mm. An upper horizontal roll 1 having an outside diameter of 400 mm was formed with a groove 12 in its peripheral surface, the groove 12 having a bottom width of 20 mm and a depth of 8 mm. Using the mill, a rolling test was achieved such that strips S of stainless steel (SUS 304) heated at 900° C. and having a thickness of 5 mm and a width of 100 mm (used in combination with the groove of 10 mm depth, in an alternative case, 85 mm width was selected for the groove of 3 mm depth) were rolled by the vertical rolls with various widthwise reductions while keeping a roll opening or gap G of 5 mm measured at the opposite ends of the horizontal rolls.

When subjected to the widthwise reduction, the steel strip buckles at a widthwise central portion, as previously described. The buckled material M' is reduced by the upper horizontal roll 1 having the groove 12 at its longitudinal central portion such that the material M' is forced to fill in a space (groove) in the upper horizontal roll 1, thereby increasing the thickness of the central portion.

Figure 13:
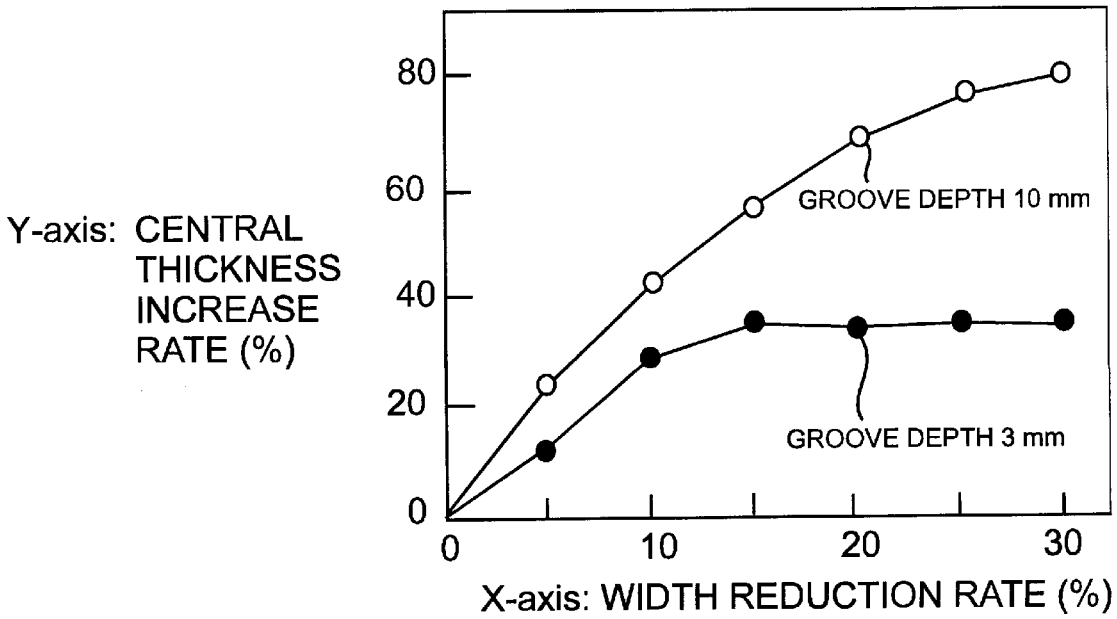
FIG. 13 is a view showing the relationship between the width reduction rate and the central thickness increase rate plotted according to the results of the width reduction test.

FIG. 13 is a view showing the relationship between the width reduction rate and the thickness increase rate obtained through a width reduction test taken in conjunction with steel strips with the use of a universal mill having grooved rolls. In this figure, the curve drawn through these points indicated by blank circles shows the results obtained when the grooves of 10 mm in depth is used, and the curve drawn through these points indicated by solid circles shows the results obtained when the grooves of 3 mm in depth is used. It appears from FIG. 13 that the thickness increase rate at the center of the steel strip increases with an increase in depth of the grooves.

The results of the width reduction test indicates that shape-rolling of a steel strip for increasing the thickness of a central portion thereof can be achieved by reducing the steel strip in the widthwise direction while restraining opposite sides of the steel strip between a pair of vertical rolls each having a groove in its peripheral surface, and simultaneously reducing the steel strip in the thickness-wise direction between a pair of horizontal rolls one of which has a groove at its longitudinal central portion. Subsequently, the shape-rolled steel strip is finish-rolled on a two high-mill having grooved rolls with the result that an angle having a sharp edge can be produced.

Figure 5A:
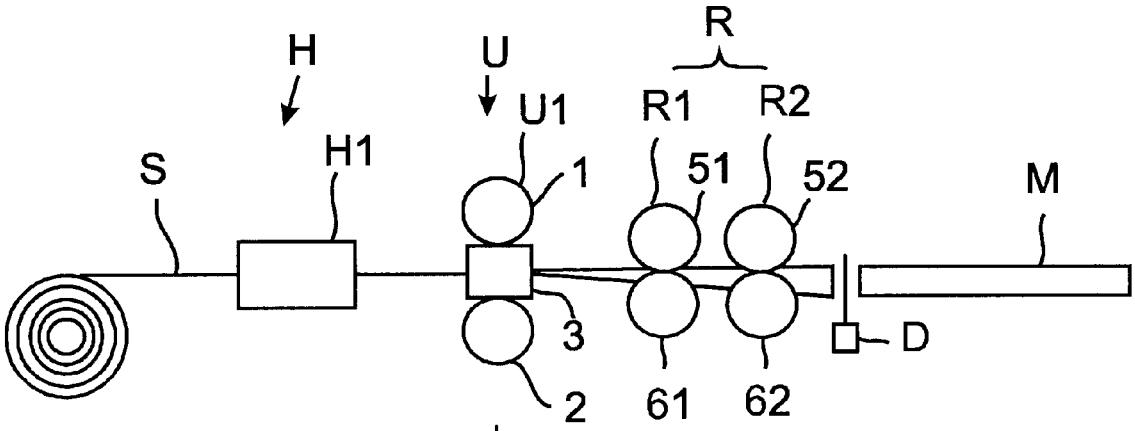
FIG. 5 is a view showing one example of a rolling system of the present invention for producing an angle from a steel strip, in which FIG. 5(*a*) is a view showing a rolling line, and FIG. 5(*b*) is a view showing the cross section of a material being rolled and the arrangement of rolls of a universal mill.
Figure 5B:
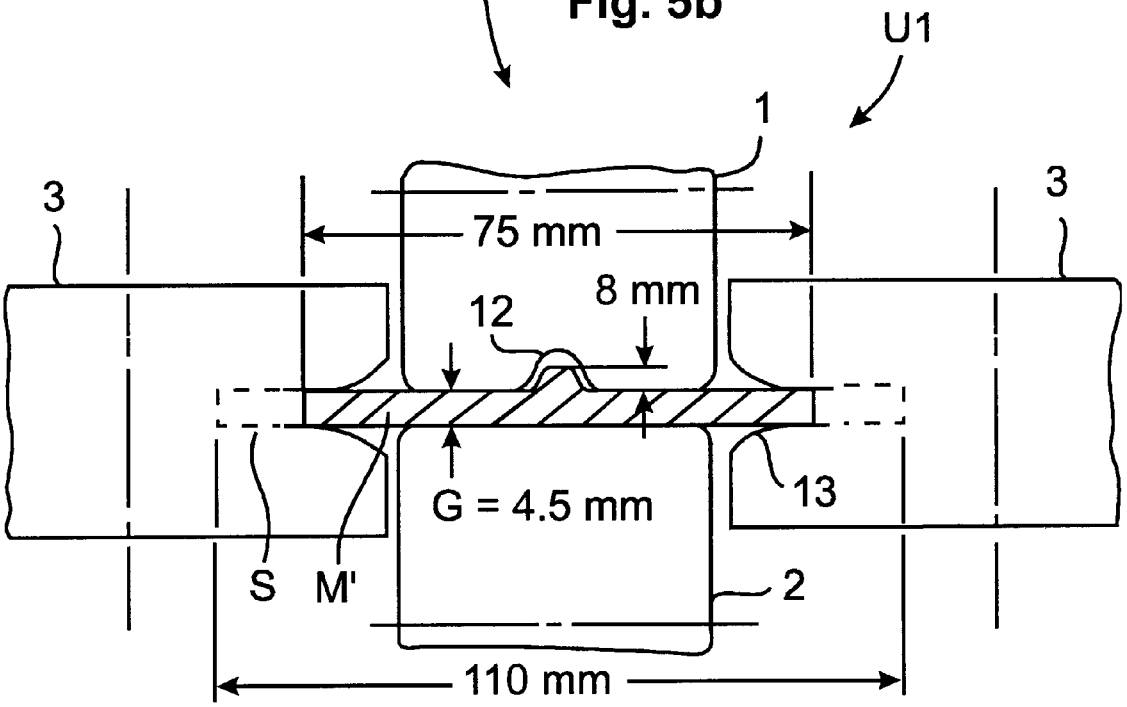

B. Rolling system for producing an angle from a steel strip by making three passes between the rolls: FIG. 5 is a view showing one example of a rolling system of the present invention for producing an angle from a steel strip, in which FIG. 5(*a*) is a view showing a rolling line, and FIG. 5(*b*) is a view showing the cross section of a material being rolled and the arrangement of rolls of a universal mill. Reference character S denotes the steel strip, H a heating apparatus including a continuous heating furnace H1, U the universal mill, R a group of two-high mills composed of a first-stage or upstream two high forming mill R1 and a second-stage or downstream two high finishing mill R2 disposed close to each other, D a shearing machine, and M a final product or angle. The universal mill and the two-high mill group are disposed close to each other in the rolling line. The term "disposed close to each other" is used herein to refer to the condition in which both mills or stands are arranged continuously without a table roll disposed therebetween.

The steel strip S is heated by the continuous heating furnace H1, then passes through the universal mill U where it undergoes a reduction in width and an increase in thickness at a central portion thereof, and thereafter is finish-rolled into an angle by means of the two high mill group R.

The universal mill Ul shown in FIG. 5(*b*) has structural features that the vertical rolls 3 have circumferential grooves 13 and hence are capable of reducing the material M' in the widthwise direction while gripping the opposite sides of the same, and at least one (an upper horizontal roll 1 in the illustrated embodiment) of two horizontal rolls 1 and 2 has a circumferential groove 12 at its longitudinal central portion and hence is capable of displacing or squeezing a part of the material toward a central portion thereof while the material is being buckled under the widthwise reduction by the vertical rolls. By virtue of the grooves 13 formed in the vertical rolls 3, the material M' causes buckling at its central portion when it is reduced in the widthwise direction by the vertical rolls 3. In this instance, since the material M' is not elongated in the rolling direction, a part of the material M' being reduced is displaced or squeezed toward a widthwise central portion of the material M' and eventually increases the thickness to such an extent that the material being rolled conforms to the profile of the horizontal rolls. During that time, since the upper horizontal roll 1 has the groove 12 at a central portion thereof, and since the horizontal rolls are set to hold a given roll opening or gap G (4.5 mm) for controlling or limiting a reduction in thickness of the material or steel strip, the widthwise reduction of the material (reduction in cross-sectional area) is converted into an increase in thickness of the central portion of the material. The material thus shaped corresponds in shape and configuration to the material shaped by making the fifth pass shown in FIG. 2.

The steel strip S is heated by the continuous heating furnace H1, and subsequently passes through the universal mill U1 having rolls arranged as shown in FIG. 5(*b*) which effect a reduction in width and an increase in thickness at the central portion of the steel strip S to shape the steel strip S into a shape corresponding to the shape attained by making the fifth pass shown in FIG. 2.

Figure 1:
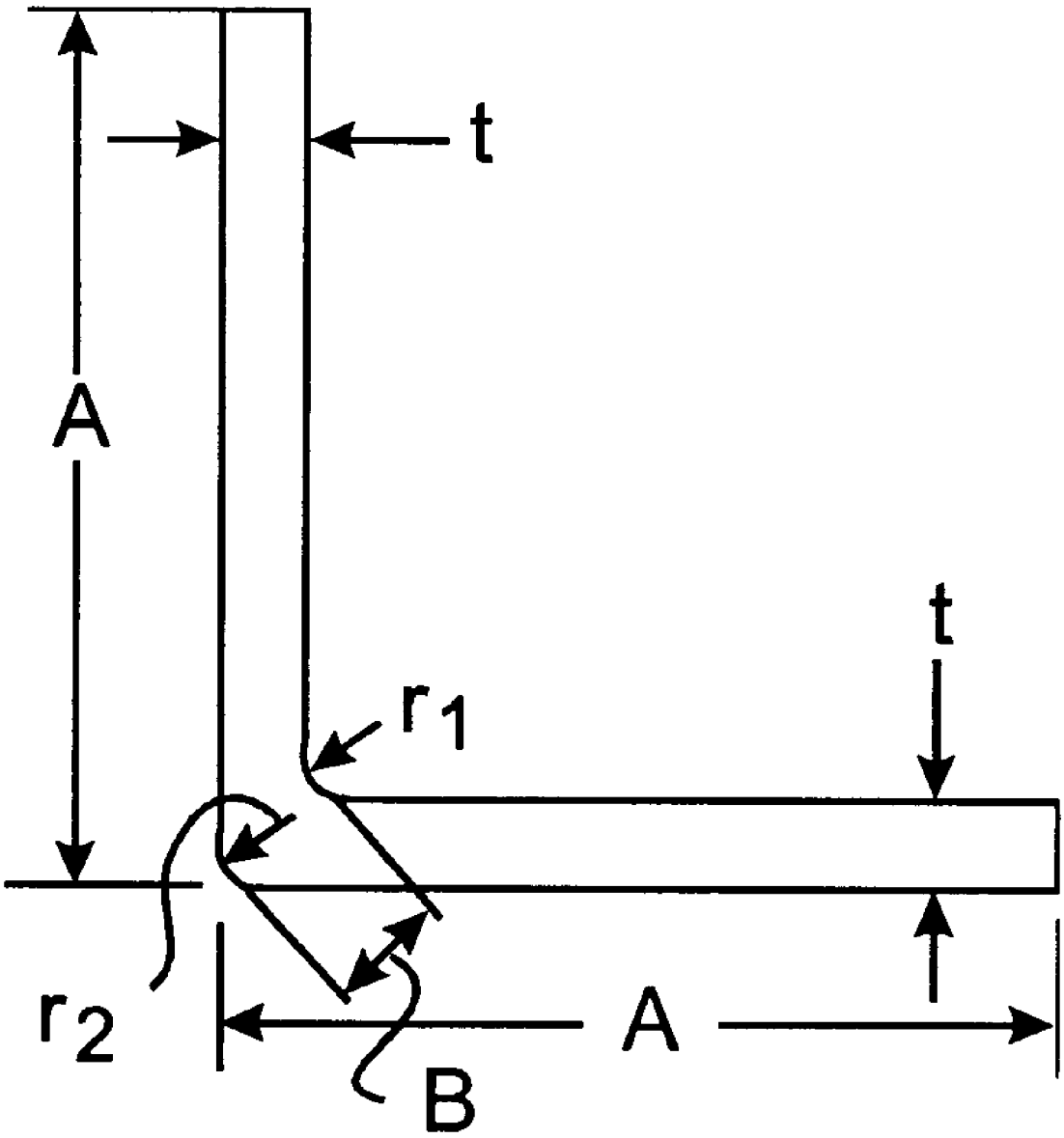
FIG. 1 is a view showing one example of the cross section of an angle.
Figure 2:
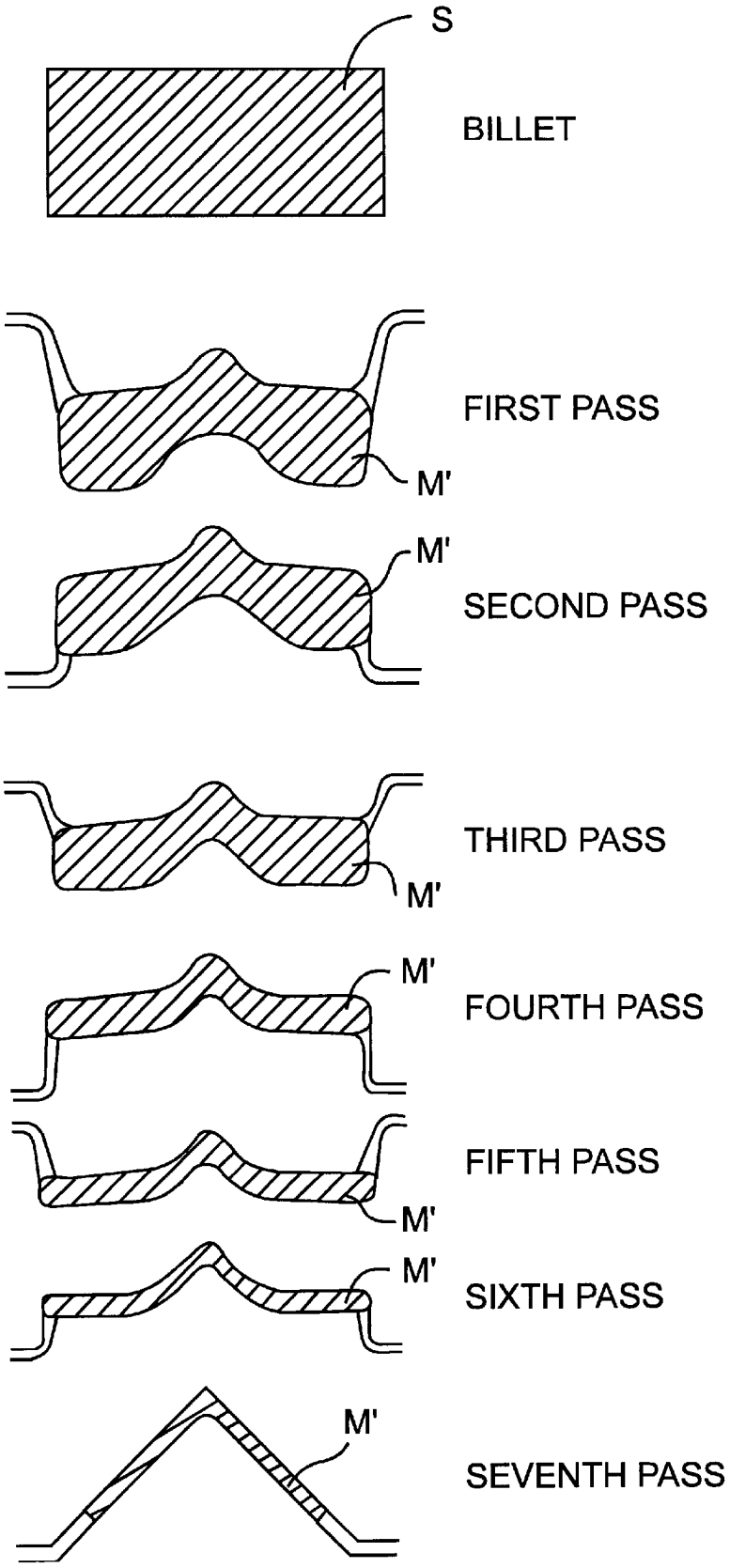
FIG. 2 is a view showing one example a set of grooved rolls and a pass schedule used for achieving a conventional rolling process.
Figure 3:
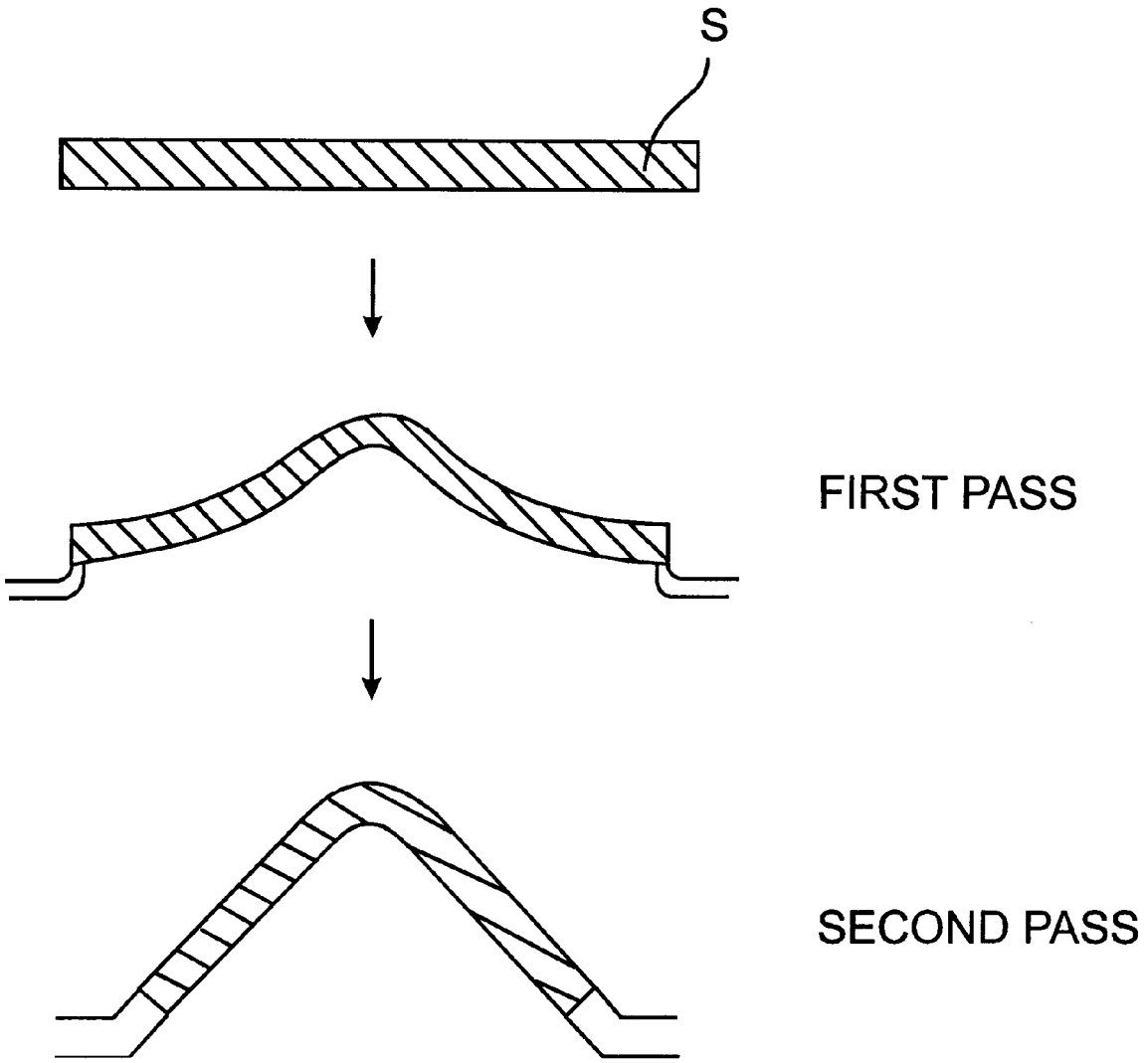
FIG. 3 is a view showing a method of producing an angle from a steel strip by a cold-forming process.
Figure 4A:
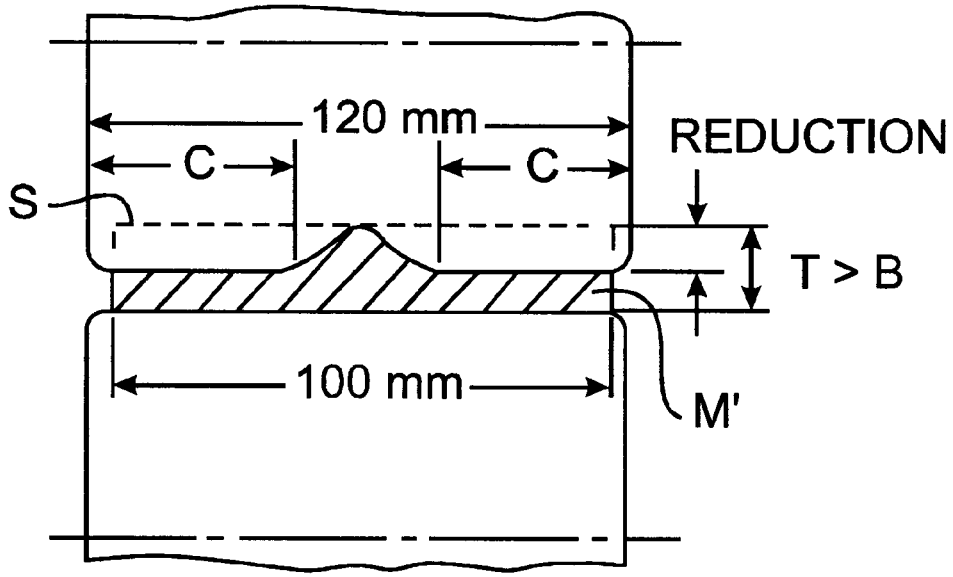
FIG. 4 is a view illustrative of the manner in which a rough-rolled material for an angle is produced from a steel strip by reducing opposite sides of the steel strip, in which FIG. 4(*a*) is a view showing the cross section of the rough-rolled material being shaped by grooved rolls, and FIG. 4(*b*) is a view showing edge waves appearing on the rough-rolled material.
Figure 4B:
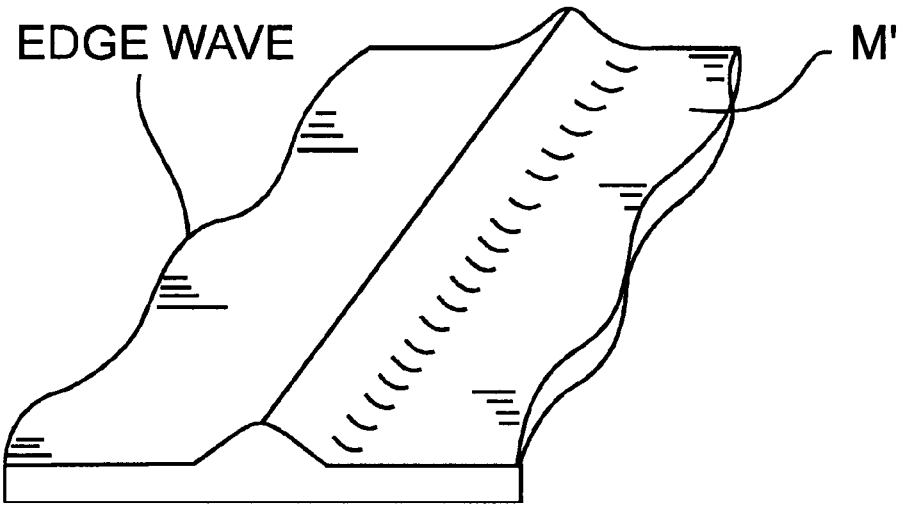

After that, the steel strip passes through the first-stage two high forming mill R1 where grooved rolls defining therebetween a roll pass equivalent to the sixth pass shown in FIG. 2 effect intermediate rolling to bent the steel strip at the central portion into an inverted V shape. Thereafter, the V-shaped steel strip passes through the second stage two-high finishing mill R2 where grooved rolls defining therebetween a roll pass equivalent to the seventh pass shown in FIG. 2 finishes the steel strip into a final product or angle having flanges bent at right angles and a sharp edge.

The rolling system of the present invention ensures that a steel strip having the same thickness as flanges of a final product or angle can be processed into an angle having a sharp edge and excellent surface qualities by making-three passes between the grooved rolls.

Figure 6A:
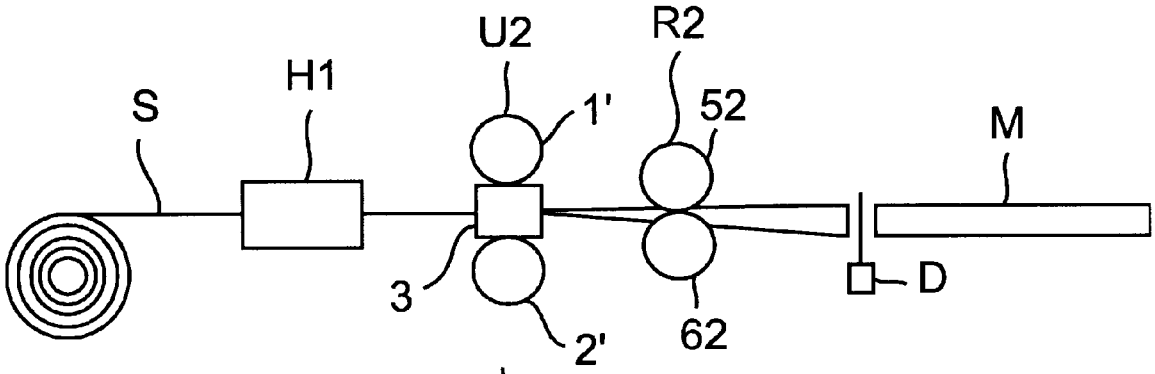
FIG. 6 is a view showing another example of the rolling system of the present invention for producing an angle from a steel strip, in which FIG. 6(*a*) is a view showing a rolling line, and FIG. 6(*b*) is a view showing the cross section of a material being rolled and the arrangement of rolls of a universal mill.
Figure 6B:
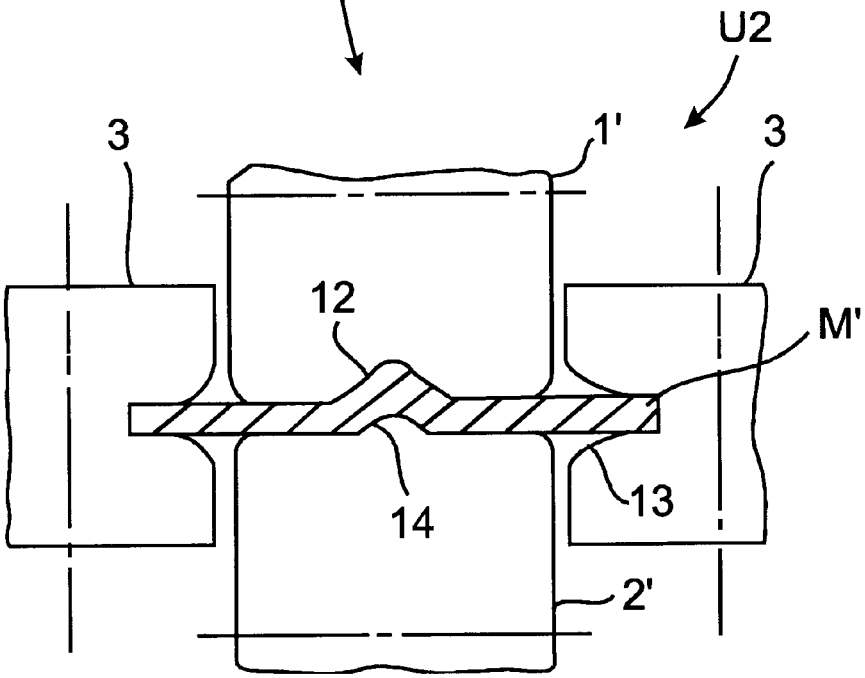

C. Rolling system for producing an angle from a steel strip by making two passes between the rolls:

FIG. 6 is a view showing another example of the rolling system of this invention for producing an angle from a steel strip, in which FIG. 6(*a*) is a view showing a rolling line, and FIG. 6(*b*) is a view showing the cross section of a material being rolled and the arrangement of rolls of a universal mill. The universal mill shown in FIG. 6(*b*) has structural features that one horizontal roll 1' has, in its peripheral surface, a groove 12 at a central portion thereof, and the other horizontal roll 2' has, on its peripheral surface, a projection 14 at a central portion thereof to ensure that a portion of the material M' while being reduced in the widthwise direction is displaced or squeezed toward a central portion.

A steel strip S having a width twice as large as the width of flanges of an angle to be produced and a thickness equal to the thickness of the flanges is heated and subsequently rolled on a universal mill U2 shown in FIG. 6(*b*) where the steel strip S is shaped into a rough-rolled material for the angle by reducing it in the widthwise direction while restraining the same in the direction of thickness. Since the vertical rolls 3 are grooved as at 13 shown in FIG. 6(*b*), the material M' causes buckling at its central portion when it is reduced in the widthwise direction by the grooved vertical rolls 3. In this instance, since the material M' is not elongated in the rolling direction, a part of the material M' being reduced is displaced or squeezed toward a widthwise central portion of the material M' and eventually increases the thickness to such an extent that the material being rolled conforms to the profile of the horizontal rolls. During that time, since the upper horizontal roll 1' has the circumferential groove 12 at a central portion thereof and the lower horizontal roll 2' has the circumferential projection 14, and since these horizontal rolls 1', 2' are set to hold a given roll opening or gap to control or limit a reduction in thickness of the material M', the widthwise reduction of the material (reduction in cross-sectional area) is converted into an increase in thickness of the central portion of the material M' . The material thus shaped corresponds in shape and configuration to the material shaped by making the sixth pass shown in FIG. 2.

With the material thus rolled, the next following two-high finishing mill may only effect finishing or shaping rolling of the material. More particularly, since the material coming out from the universal mill U has a shape resembling with the shape obtained by making the sixth pass shown in FIG. 2, the two-high finishing mill R2 may only effect rolling of the material to form a shape edge and provide the squareness between flanges. The angle shaped by the universal mill U2 has a corner portion whose thickness is greater by about 50% than the thickness of the flanges, and further has a corner angle. Thus, the angle of a desired shape can be formed via a relatively light rolling process which also insures excellent surface qualities of the angle.

Figure 7A:
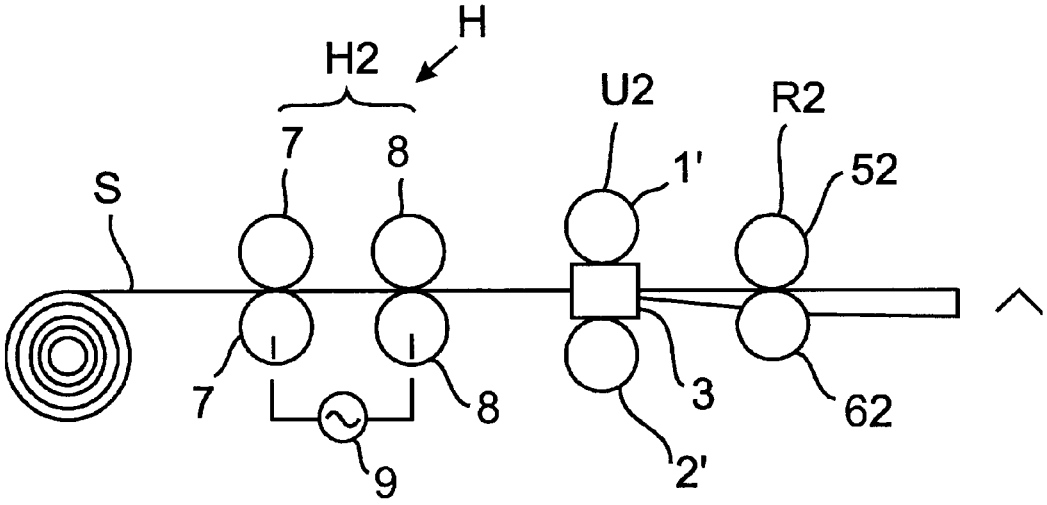
FIG. 7 is a view showing an angle rolling system in which a current-applying heating system is employed.

D. Rolling system using a heating apparatus including direct current-applying heating:

FIG. 7 is a view showing an angle production system using a current-applying heating system.

A heating apparatus designated by H is composed of a direct current-applying heating apparatus H2 including two pairs of current supply rolls 7 and 8 disposed one behind the other in the running direction of a steel strip, with rolls in each pair disposed vertically one above the other with the steel strip held therebetween. Reference character 9 denotes an electric power supply, U2 a universal mill, R2 a group of two-high mills with grooved rolls, S the steel strip, and M a final product or angle. The universal mill U2 may be of the type U2 having a horizontal roll 1' having a groove, and a horizontal roll 2' having a projection, or alternatively of the type U1 having a grooved horizontal roll and a flat or ungrooved horizontal roll. When the universal mill U2 is used, the two-high mill group is composed solely of a finishing mill R2, and alternatively when the universal mill U1 is used, the two-high mill group is composed of a shape-rolling mill R1 with grooved rolls and a finishing mill R2.

As illustrated, the steel strip S is heated at a predetermined temperature as it passes between two current supply roll pairs 7 and 8. Then, the heated steel strip S is shaped into a rough-rolled material by the universal mill U2 which effects widthwise reduction of the steel strip to increase the thickness of a central portion of the steel strip. Thereafter, the rough-rolled material is rolled into an angle of a product size by means of the finishing mill R2 with grooved rolls. When the direct current-applying heating apparatus is operated with an electric power condition of 20V at 6,000A, the rolling speed obtained is relatively low, such as about 0.2 m/s; however, the electric power supply or equipment is extremely inexpensive. On the other hand, when the continuous heating furnace is employed, it requires a high equipment cost; however, due to a high rolling speed available, such as 5 m/s, the production efficiency of the rolling system increases greatly. However, in view of the underlying domestic demands of small-sized stainless steel angles, the direct current-applying heating system can well meet the demands, and hence is considered to be a most suitable heating system for the small-sized stainless steel angles.

E. Moving of the front current supply rolls:

In a usual current-applying heating apparatus, a leading end portion of the steel strip cannot be heated, and hence rolling of this leading portion is not achievable in a desired manner. To deal with this problem, a direct current-applying system of the type having movable current supply rolls was completed according to the present invention.

Figure 8:
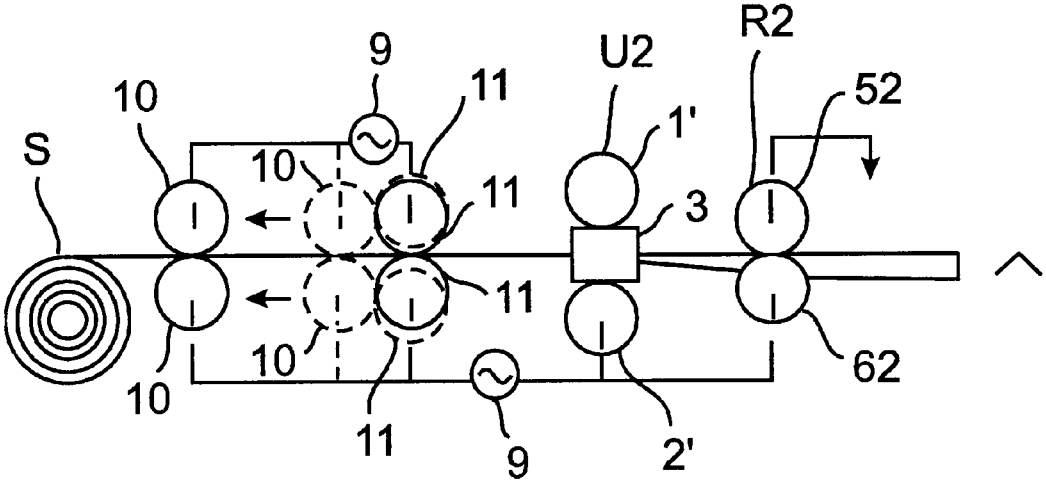
FIG. 8 is a view showing an angle rolling system including a grounded two high mill having grooved rolls.

FIG. 8 is a view showing an angle rolling system including movable current supply rolls, releasable current supply rolls, an insulated universal mill and a grounded two-high finishing mill. In this figure, reference character 10 denotes the aforesaid current supply rolls which are movable in a direction parallel to the running direction of the steel strip, and 11 the aforesaid current supply rolls which include a roll releasing device for releasing the current supply rolls from rolling contact with the steel strip.

In operation, the current supply rolls 10 are moved or shifted to a position close to the current supply rolls 11, as indicated by the broken lines in FIG. 8, and when the steel strip is bit by the current supply rolls 11, running movement of the steel strip is stopped and the current supply rolls 10 are moved in a direction opposite to the running direction of the steel strip toward the position (indicated by the solid lines). During that time, an electric current is continuously applied to the steel strip.

When the temperature of the steel strip measured at a position near the current supply rollers 10 reaches a predetermined value, movement of the current supply rollers 10 is stopped and, at the same time, running of the steel strip is restarted. Thereafter, when the steel strip is bit between the rolls in the finishing mill R2, the current supply rolls 11 are displaced vertically away from each other and thereby released from contact with the steel strip whereupon current applying heating of the steel strip is achieved between the current supply rolls 10 and the finishing mill R2.

Thus, the steel strip can be heated at a predetermined rolling temperature from its leading end portion backwards.

A device for moving the current supply rolls 10 may include a known ball screw unit, and a fluid-pressure cylinder actuator, such as a hydraulic cylinder or a pneumatic cylinder, used in combination with a slidable support.

While the current supply rolls are moving along the steel path, they are either rotated positively or kept freely rotatable in response to movement of the steel strip relative to the current supply rolls.

The roll releasing device for vertically displacing the current supply rolls away from each other may include a device including a fluid-pressure cylinder actuator, such as a hydraulic cylinder or a pneumatic cylinder, a device including in combination a fluid-pressure cylinder actuator and a spring or a link mechanism.

F. Insulation of the universal mill and grounding of the two-high mill with grooved rolls:

In a process of rolling small-sized angles using a rolling system including a continuous heating furnace or a usual current-applying heating apparatus, the material to be rolled encounters a great temperature drop during the rolling which deteriorates surface qualities of a final product or angle. However, in the case where a current is applied from the current supply rolls 10 to the steel strip, with the universal mill U2 insulated and with the two-high finishing mill R2 grounded, as shown in FIG. 8, the steel strip can be heated even when it passes through the universal mill U2 and the two-high finishing mill R2. To insulate the universal mill U2, an insulating mat is placed over the foundation of the universal mill, and insulated couplings are incorporated in a power line including a drive shaft.

G. Device for increasing the temperature of the widthwise central portion of the steel strip:

According to one important feature of the present invention, a steel strip is reduced in the widthwise direction to increase the thickness of a central portion of the steel strip. In order to increase the thickness of the central portion of the steel strip, the central portion of the steel strip should preferably be deformed to a greater extent for which purposes the temperature of the central portion of the steel strip should preferably be increased correspondingly.

Figure 14:
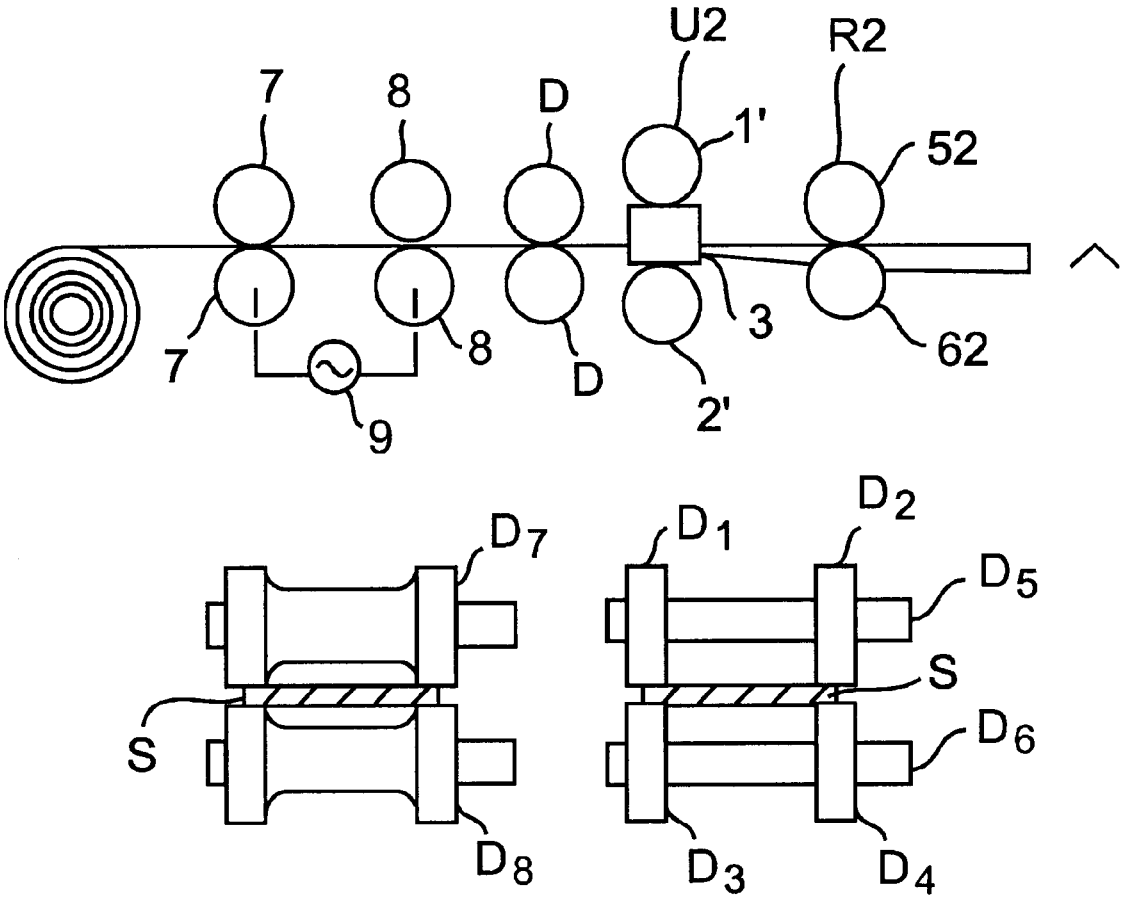
FIG. 14 is a view showing an angle rolling system including a temperature regulating device disposed upstream of a universal mill for regulating the temperature of a steel strip.

FIG. 14 shows an angle rolling system including a temperature regulating device disposed upstream of the universal mill for regulating the temperature of the steel strip. In this figure, the temperature regulating device is designated by D and, in one preferred form, this device D is composed of two pairs of laterally spaced circular disks or wheels ($D_1$, $D_2$ and $D_3$, $D_4$) disposed one on each side of the steel strip. In each wheel pair, two wheels are mounted on a shaft ($D_5$, $D_6$) such that the distance between these wheels can be adjusted. The two wheel pairs cooperate to grip opposite side edges of the steel strip and are rotatable in response to the longitudinal movement of the steel strip.

By virtue of the wheels thus arranged, the temperature of the opposite sides of the steel-strip goes below the temperature of the central portion of the steel strip by about 200° C. With a temperature difference thus created, the central portion of steel strip can be readily formed in such a manner as to increase its thickness when the steel strip is reduced widthwise by the universal mill U2. This will ensure that an angle can be produced from a steel strip of the shape having a thickness which is the same as the thickness of flanges of the angle, and a width which is approximately twice as large as the flange width of the angle.

The four wheels ($D_1$–$D_4$) may be replaced with a pair of upper and lower rolls ($D_7$, $D_8$) each having a reduced or small-diameter central portion. As a further alternative, a device for cooling the opposite sides of the steel strip by a coolant, or a device for heating the central portion of the steel strip by combustion gas can be used as the aforesaid temperature regulating device.

As described above, according to the methods of the present invention for producing an angle, a steel strip is shape-rolled by a universal mill having grooved rolls which effect a reduction in width of the steel strip and an increase in thickness of a central portion of the steel strip, and thereafter the shape-rolled steel strip is rolled by a group of two-high mills each having grooved rolls by making one or two passes between the grooved rolls. The angle rolling methods require only a short rolling time such as 10 seconds or less, can maintain a finish rolling temperature above 800° C. even when the heating temperature is 950° C., and can insure production of angles having excellent surface qualities. Furthermore, by the use of a direct current-applying heating apparatus, a further increase in the finish rolling temperature is possible with a solution heat treatment which can be incorporated to quench the product or angle after the rolling.

EXAMPLE 1

The present invention will be described in greater detail by way of the following examples.

A rolling line shown in FIG. 5(*a*) was used as a rolling system, including a universal mill U1 having rolls (vertical rolls having a diameter of 300 mm and horizontal rolls having a diameter of 400 mm) of the shape and configuration shown in FIG. 5(*b*), and two stands of two-high mills R1 and R2 each having grooved rolls (of 400 mm in diameter), the grooved rolls in the first-stage stand R1 defining therebetween a sixth pass shown in FIG. 2 and the grooved rolls in the second-stage stand R2 defining therebetween a seventh pass shown in FIG. 2. From a steel strip of stainless steel (SUS 304) having a thickness of 4.5 mm and a width of 110 mm used as a material to be rolled, an angle of the product size: 40×40×4 was produced by making three passes between the grooved rolls.

The vertical rolls 3 of the universal mill had a circumferential groove of trapezoidal shape in cross section having a bottom width of 4.5 mm, a depth of 10 mm and a taper angle of 5°. The upper horizontal roll had a circumferential groove of a valley-like shape in cross section having an open end width of 30 mm, a depth of 8 mm and a radius of 10 mm at the bottom. The first-stage or upstream two-high mill R1 had grooved rolls defining therebetween the sixth pass shown in FIG. 2, and the second-stage or downstream two-high finishing mill R2 had grooved rolls defining therebetween the seventh pass shown in FIG. 2.

The steel strip was heated to 950° C. by the continuous heating furnace H1, and then was passed through the universal mill U1 where the rolls effected rolling so as to reduce the width of the steel strip to 75 mm and increase the thickness of the central portion of the steel strip to 8 mm at the maximum. Subsequently, the steel strip passed through the two-high mill R1 where the rolls effected intermediate rolling to bend of the central portion the material or steel strip into an inverted V shape. Thereafter, the inverted V-shaped steel strip was shape-rolled into an angle of the 40×40×4 size by the two-high finishing mill R2.

The angle thus produced had a corner portion having an outside radius of 1.0 mm, and flanges of the angle had good surface qualities. The rolling speed was 5 m/s and the productive efficiency was 40 tons/hour which is about two times the productive efficiency of a conventional rolling method (four stands cross-country mill).

EXAMPLE 2

A rolling system used was composed of a rolling line shown in FIG. 6(*a*), including a universal mill U2 having rolls (vertical rolls having a diameter of 300 mm and horizontal rolls having a diameter of 400 mm) of the shape and configuration shown in FIG. 6(*b*), and a two-high mills R2 having grooved rolls (of 400 mm in diameter) defining therebetween a seventh pass shown in FIG. 2. The material to be rolled was the same steel strip as Example 1, and an angle of the size 40×40×4 was produced from the steel strip by two passes of rolling operation.

The vertical rolls of the universal mill U2 had a circumferential groove of trapezoidal shape in cross section having a bottom width of 4. 5 mm, a depth of 10 mm and a taper angle of 5°. The upper horizontal roll had a circumferential groove of a valley-like shape in cross section having an open end width of 30 mm, a depth of 8 mm and a radius of 10 mm at the bottom. The lower horizontal roll had an annular projection at a longitudinal central portion thereof, the projection having the same radius as the fillet radius of the angle, a height of 2 mm and a base width of 10 mm. The two-high finishing mill R2 had grooved rolls defining therebetween the seventh pass shown in FIG. 2.

The strip of stainless steel (SUS 304) having a width of 110 mm and a thickness of 4.0 mm was heated to 950° C. by the continuous heating furnace H1, and then was passed through the universal mill U2 where the rolls effected rolling to reduce the width of the steel strip to 75 mm and increase the thickness of a central portion of the steel strip to 8 mm at maximum. At that time, by virtue of the projection 14 provided at the central portion of the lower horizontal roll 2, the steel strip was shaped into a rough-rolled material having a cross-sectional shape resembling that attained by making the sixth pass shown in FIG. 2.

The rough-rolled material, due to its cross-sectional shape described above, could be readily finished into an angle of the 40×40×4 size by passing it through the two-high finishing mill having grooved rolls defining therebetween the seventh pass shown in FIG. 2.

The angle thus produced had a corner portion having an outside radius of 1.0 mm, and flanges of the angle had good surface qualities. The rolling speed was 5 m/s and the productive efficiency was 40 tons/hour.

EXAMPLE 3

Using an angle rolling system including a current applying heating apparatus shown in FIG. 7, an angle of the 30×30×3 size was produced from a steel strip (of stainless steel SUS 304) having a thickness of 4 mm and a width of 75 mm. The universal mill and the two-high mill both used in Example 2 were used again in this Example. An electric current was applied to a portion of the steel strip extending between the current supply rolls 7 and the current supply rolls 8 until the temperature of the steel strip measured at the outlet side of the current supply rolls 8 equaled to 1,100° C. Then, the steel strip passed through the universal mill where the grooved rolls effected rolling of the steel strip to reduce the width of the same from 75 mm to 60 mm (reduction =15 mm) and increase the thickness of a central portion of the steel strip to 4.5 mm at maximum. Thereafter, the two-high finishing mill R2 rolled the steel strip to effect a reduction in thickness of the flanges to 3 mm, thereby completing an angle of the desired size.

The rolling speed achieved with the use of the current-applying heating system was 0.2 m/s, and hence could provide a lower production efficiency than the rolling system in which a heating system composed of the continuous heating furnace is used. However, the necessary equipment cost of the current-applying heating system was ten percent of that of the continuous heating furnace, and hence should preferably be considered as the most suitable heating system to be employed when a new rolling system is installed for the production of small-sized stainless steel angles, although the production of small-sized stainless steel angles has in little demand.

EXAMPLE 4

Using an angle rolling system including a current-applying heating apparatus shown in FIG. 8, an angle of the size 20×20×3 was produced from a steel strip (of stainless steel SUS 304) having a thickness of 4 mm and a width of 50 mm. The upstream current supply rolls 10 were held in a position (indicated by the broken lines) closer to the downstream current supply rolls 11. While keeping this condition, the steel strip was fed or run longitudinally until the leading end of the steel strip was bit by the downstream current supply rolls 11 whereupon the running movement of the steel was stopped. At the same time, the upstream current supply rolls 10 were moved in a direction (indicated by the arrows in FIG. 8) opposite to the running direction of the steel strip during which time a current was applied to the steel strip.

When the temperature of the steel strip rose to 1,100° C., the steel strip was fed again in the downstream direction, and simultaneously therewith, the downstream current supply rolls 11 were displaced vertically away from each other (as indicated by the broken lines), and hence released from rolling engagement with the steel strip. Thus, the current was applied to a portion of the steel strip running between the upstream current supply rolls 10 and the two-high finishing mill R2.

The steel strip was rolled on the universal mill during which time the width of the steel strip was reduced from 50 mm to 40 mm (reduction=10 mm) and the thickness of a central portion of the steel strip was increased to 4.5 mm.

Thereafter, the two-high finishing mill effected a finish rolling process to reduce the thickness of the steel strip to 3 mm. Thus, an angle of the desired size was produced.

In the case of the current-applying heating apparatus shown in FIG. 7, a leading end portion of the steel strip cannot be heated. Accordingly, an angle produced from such unheated leading end portion is defective in shape and configuration, resulting in a low yield. However, in the case of the-current-applying heating apparatus shown in FIG. 8, the steel strip can be heated from its leading end backwards, so that the yield is increased. In addition, since the steel strip is further heated between rolls of the universal mill and between rolls of the two-high finishing mill, a high finish rolling temperature (above 850° C., for example) is achieved. Such additional heating ensures that a quenching process, such as an on-line solution heat treatment can be incorporated to quench the steel strip after the rolling.

Capability of Exploitation in Industry

An angle rolling system of this invention is capable of producing an angle of excellent surface qualities and having a sharp edge, with high efficiency from a steel strip. In one form of the rolling system, a current-applying heating apparatus is incorporated to increase the finish rolling temperature to such an extent that an on-line solution heat treatment can be achieved after the rolling. The rolling system which is equipped with the current-applying heating apparatus can increase the yield and is particularly suitable for the production of angles made of stainless steel. The rolling systems and rolling methods using them can be widely used in the field of production of angles for use in kitchens and chemical plants.

I claim:

1. A rolling system for producing an angle steel from a steel strip, said rolling system comprising:

a heating apparatus for heating the steel strip in a run as the steel strip passes therethrough, a universal mill for pressing the steel strip in a thickness direction, and a group of two-high mills, the heating apparatus, the universal mill, and the group of two high mills being closely disposed in a rolling direction so as to form the heated steel strip into an angle;

the universal mill being provided with one pair of vertical rolls having grooves formed thereon and one pair of horizontal rolls, one of said horizontal rolls having a groove formed on the center of the longitudinal length of the roll; and the group of two high mills including at least two pairs of two high mills;

wherein the heating apparatus comprises current supply rolls, the universal mill comprises an insulated universal mill, and the two-high mills comprise grounded two-high mills; and wherein the heating apparatus comprises two pairs of said current supply rolls, one of which is provided with a device for moving the current supply rolls in a running direction of the steel strip, and the other one of which is provided with a device for releasing the current supply rolls.

2. A method of producing an angle steel from a steel strip by using a current-applying heating apparatus, a universal mill, and two high mills, the method comprising the steps of:

disposing, prior to starting the rolling of the steel strip, a pre-stage pair and a post-stage pair of upper and lower current supply rolls contained in the current-applying heating apparatus so that the two pairs of current supply rolls are close to each other in the running direction of the steel strip;

halting the steel strip when the steel strip is bitten into by the post-stage current supply rolls and applying a current while moving the pre-stage current supply rolls in a direction opposite to the running direction of the steel strip;

running the steel strip at the rolling speed when the steel strip reaches a specific temperature; at the same time releasing the steel strip from the post-stage current supply rolls, and applying a current to heat the steel strip between the pre-stage current supply rolls and the universal mill, or between the pre-stage current supply rolls and the two high mills;

pressing the steel strip in the cross direction thereof and pressing the steel strip in the thickness direction thereof to thereby increase a thickness of the steel strip at the center of the width thereof by using the universal mill, in which are disposed a pair of vertical rolls having grooves formed thereon and a pair of horizontal rolls, one of which has a groove formed on the center of the longitudinal length of the roll; and finishing the steel strip into an angle by using two or more passes of the two high mills.

3. A method of rolling an angle steel from a steel strip by using a current-applying heating apparatus, a universal mill, and two high mills, the method comprising the steps of:

disposing, prior to starting the rolling of the steel strip, a pre-stage pair and a post-stage pair of upper and lower current supply rolls contained in the current-applying heating apparatus so that the pairs of the current supply rolls are close to each other in the running direction of the steel strip;

halting the steel strip when the steel strip is bitten into by the post-stage current supply rolls and applying a current while moving the pre-stage current supply rolls in a direction opposite to the running direction of the steel strip;

running the steel strip at the rolling speed when the steel strip reaches a specific temperature; at the same time releasing the steel strip from the post-stage current supply rolls, and applying a current to heat the steel strip between the pre-stage current supply rolls and the universal mill, or between the pre-stage current supply rolls and the two high mills;

pressing the steel strip in the cross direction thereof and pressing the steel strip in the thickness direction thereof to thereby increase a thickness of the steel strip at the center of the width thereof by using the universal mill, in which are disposed one pair of vertical rolls having grooves formed thereon and one pair of horizontal rolls, one of which has a groove formed on the center of the longitudinal length of the roll, and the other one of which has a projection formed on the center of the longitudinal length of the roll; and finishing the steel strip into an angle by using one or more passes of the two high mills.

* * * * *